US005692808A

United States Patent [19]

Heuvelman

[11] Patent Number: 5,692,808

[45] Date of Patent: Dec. 2, 1997

[54] APPARATUS AND METHOD FOR REJUVENATION OF A BRUSH

[76] Inventor: George M. Heuvelman, P.O. Box 544, Burlington, Ill. 60109

[21] Appl. No.: 697,640

[22] Filed: Aug. 29, 1996

[51] Int. Cl.[6] ..... A46D 1/00

[52] U.S. Cl. ..... 300/21; 15/1; 15/257.01; 29/402.05

[58] Field of Search ..... 15/257.01, 180, 15/1; 300/8, 11, 21; 29/240, 402.05

[56] References Cited

U.S. PATENT DOCUMENTS 4,884,311 12/1989 Gergory ..... 15/257.01
5,042,107 8/1991 Gregory ..... 15/257.01

FOREIGN PATENT DOCUMENTS 0193581 1/1938 Switzerland ..... 15/257.01

*Primary Examiner*—David Scherbel
*Assistant Examiner*—Randall Chin
*Attorney, Agent, or Firm*—Mathew R. P. Perrone, Jr.

[57] ABSTRACT

A brush rejuvenating apparatus has a main housing including an inner bristle collector guide and an outer bristle collector guide which cooperate with a series of bristle combs to drive bristles into a rejuvenating position or a straight array, to be therein until the brush has dried.

19 Claims, 3 Drawing Sheets

APPARATUS AND METHOD FOR REJUVENATION OF A BRUSH

This invention relates to a rotary scrubbing brushes employed to clean carpets and floors, and more specifically, to an apparatus and method for rejuvenation of a brush by straightening of the brush bristles after the bristles have been bent or flexed in use.

BACKGROUND OF THE INVENTION

Rotary scrubbing brushes are customarily used on a machine for carpet scrubbing, floor scrubbing and other hard surface scrubbing and cleaning. With a machine using this rotary brush, a floor or other hard surface may be cleaned in an efficient manner. Mounted on such a machine for the direct surface or other floor contact is such a rotary brush. The rotary brush serves well for cleaning.

The brush is mounted on the base of the machine in contact with the floor. The machine provides the power to rotate the brush. Customarily in the industry the brush rotates in a clockwise position. With this use, the brushes can be permanently bent in one direction causing the brush to become ineffective as a scrubbing tool.

Typically, machines used in the industry have the brushes rotating in a clockwise direction as one looks down on the top of the machine. Such rotation forces the brush bristles in a counterclockwise direction. When the bristles of the brush tend to stay in that counterclockwise direction, the brush loses its effectiveness as a cleaning agent and must be replaced at considerable expense.

This type of machine, with the rotary brush attached thereto, requires a certain degree of expertise to operate. Due to the brush rotation lifting up on the handle causes the machine to move to the right. Pushing down on the handle causes the machine to move to the left. The forward motion is accomplished by placing weight on the right hand side of the handle. The rearward motion is accomplished by placing weight on the left hand side of the handle. These factors indicate that it requires a reasonable amount of skill to direct the machine using the rotary scrubbing brush in the appropriate manner.

While it is possible to incorporate a reversing mechanism on the machine, and avoid having the brush move in one direction entirely, such a reversing mechanism causes too much confusion in the adjustment of how to handle the machine for the operator. The standard procedures of handling and operating are completely reversed.

Also, it is somewhat difficult to examine the brush in use and make the appropriate reversal at the desired time. It is clearly necessary to be able to efficiently examine the brush and reverse the machine rotation thereof at the appropriate time.

What is desired is a device which can apply pressure on the bristles and reverse the bristles at the convenience of the operator. If such a reversal of the bristles can be accomplished, the life of the brush can be increased by a factor of at least two (2), if not four (4).

In U.S. patent application Ser. No. 08/477,411 filed Jun. 7, 1995, now pending by George M. Heuvelman, the inventor of this application, an apparatus and method for restoring bristles of a rotary brush is shown to be especially useful for restoring brush with respect to the outside bristles. The inner circle of bristles needs to be more thoroughly addressed.

More particularly, the rotary brush has a how center with bristles extending from one side thereof. In a brush rejuvenation process, it is highly advantageous to support both the inner circle of bristles and the outer circle of bristles in a drying position so that the entire brush may be rejuvenated. However, the inner support is a difficult feature to obtain while at the same time getting the outer bristles supported for a straightening procedure. If a device can be developed so that the inner support can be mastered while the outer support is achieved, great advantages can be obtained.

SUMMARY OF THE INVENTION

Therefore, among the many objectives of this invention is to provide an apparatus for reversing the position of bristles of a rotary brush.

A further objective of this invention is to provide an apparatus to increase the useful life of a rotary brush.

A still further objective of this invention is to provide an apparatus to simplify the operation of a machine on which a rotary brush is used.

Yet a further objective of this invention is to provide an apparatus to eliminate the need for a reversing mechanism on a machine using a rotary brush.

Also an objective of this invention is to provide an apparatus for applying pressure to the bristles of a rotary brush.

Another objective of this invention is to provide an apparatus for reversing the bristles of a used brush.

Yet another objective of this invention is to provide an apparatus for holding the bristles of a brush in a desired position.

Still another objective of this invention is to provide an apparatus for increasing the life of a rotary brush.

A further objective of this invention is to provide an apparatus for holding both the inner bristles and the outer bristles of a rotary brush for the purpose of rejuvenating the brush.

A still further objective of this invention is to provide a method for rejuvenating a rotary brush.

These and other objectives of the invention (which other objectives become clear by consideration of the specification, claims and drawings as a whole) are met by providing a brush rejuvenating apparatus having a main housing including an inner bristle collecting guide and an outer bristle collecting guide, which cooperate with a series of bristle combs to drive bristles into a rejuvenating position or a straight array, in which the bristles are held until dried.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
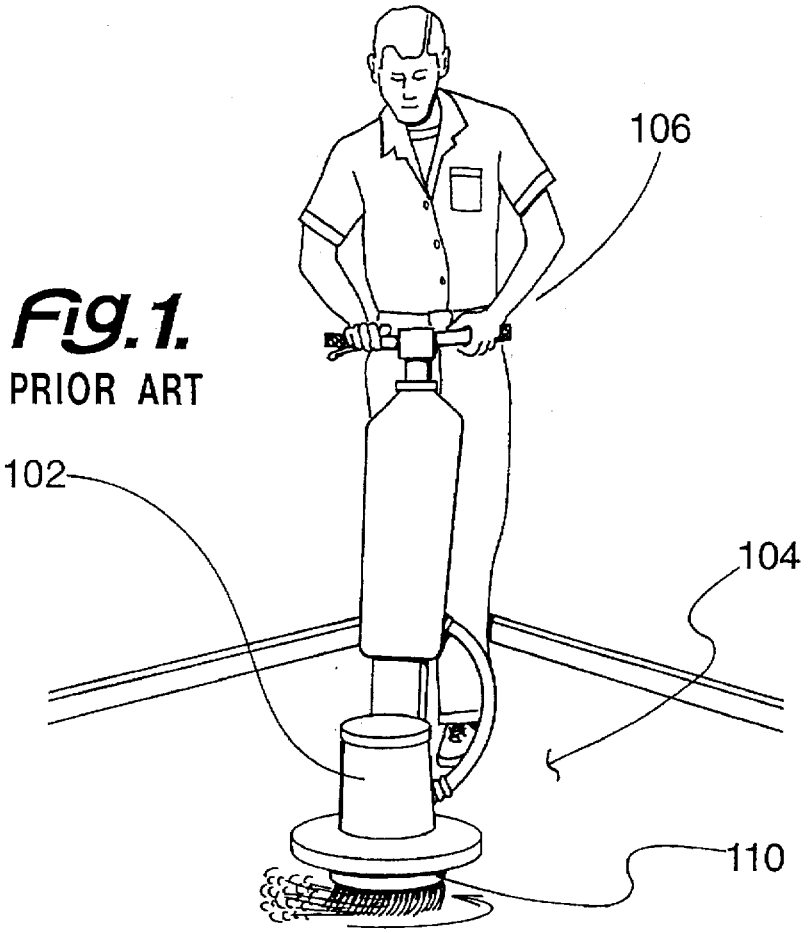
Fig. 1. PRIOR ART
FIG. 1 depicts a rotary brush 110 in use.

The brush rejuvenating apparatus of this invention includes a main housing and a number of supporting elements. The supporting elements may be removably or permanently attached to the housing. This main housing is preferably circular in nature.

The standard rotary brush includes a mounting board having a clutch plate on one side thereof and the bristles on the other side thereof. The mounting board and, in particular, the clutch plate permit the brush to lock onto the power machine. The structure of the mounting board or clutch plate is now useful for rejuvenating the brush after use.

On the main housing, there is a bristle receiving side, having an inner bristle collecting guide and an outer bristle collecting guide mounted thereon. Spaced about the base of the support which supports both the outer bristle collecting guide and the inner bristle guide is a series of bristle combs such as comb assembly.

The outer bristle collecting guide, the inner bristle collecting guide and the series of bristle combs are preferably permanently attached supporting elements. The series of bristle combs are situated between the outer bristle collecting guide and the inner bristle guide.

Each member of the comb assembly includes a main triangular shaped inclined plane as a hurdle and a series of higher inclined planes as a comb. The hurdle provides the base for each member of the comb assembly and has a triangular cross-section. For the hurdle, the basic shape is thus a triangular solid. The bristles thus first contact the base of a right triangle in the higher inclined planes, and then contact the hurdle.

The comb includes a series of larger triangular solids expanding beyond the hurdle base, due to a larger comb base. The larger triangular solid form an appearance similar to the teeth of a standard comb, while the hurdle provides the comb base.

The comb assembly is also meant to restrict the bristles from flexing sideways once they have contacted the hurdle produced by each comb. As the bristles are driven into the hurdles and the comb, they tend to flare outwardly just prior to being reversed by the hurdle. The combs protrude (extend) forward of the hurdle and collect the bristles into a channel prior to being reversed by the hurdle.

As the brush is rotated in a clockwise direction in combination with removable supporting elements, any bristles outside outer collecting guide and inside the inner collecting guide are collected and driven appropriately into a straight array.

Bristles adjacent to the outer bristle collecting guide are driven inside the outer bristle collecting guide and bristles adjacent to the inner bristle collecting guide are driven outside the inner bristle collecting guide. In this fashion, both sides of the bristles are held in the proper position for drying and the brush can be rejuvenated in an appropriate fashion.

As the bristles are driven inside the outer collecting guide and bristles adjacent to the inner bristle collecting guide, comb assemblies radially spaced therebetween contact the bristles. The comb assemblies thus provide a straightening force cooperating with the outer bristle collecting guide are driven inside the outer collecting guide and the inner bristle collecting guide to straighten the brush.

Thus, the bristles of the brush are placed on the bristle receiving side of the housing. A clamping device is placed on top of the brush to engage the plate. The clamping device is rotated in a reverse direction of the bristles until the bristles become straightened or slightly reversed. The brush bristle side can be placed on the bristle receiving side and the brush rotated in a counter-clockwise manner until the brushes are straight or a little bit beyond that point.

The clamping device is then locked in place with either a bolt secured to the plate or a plate followed by a bolt. With this rotation and the locking, the brush is held in the desired position until the bristles dry. After the brush is dried with its bristles held in the desired position, it is then ready for reuse. The straightened bristles provide for a brush to have a much longer life than a brush that is never straightened.

Referring now to FIG. 1, a power machine such as a carpet shampoo machine 102 has a brush 110 secured thereto in operation. The carpet shampoo machine 102 is typically a carpet shampooer power machine 102 being applied to carpet 104. The rotary brush 110 for carpet 104 is secured to the machine 102. The carpet shampoo machine 102 is maneuvered by an operator 106.

Figure 2:
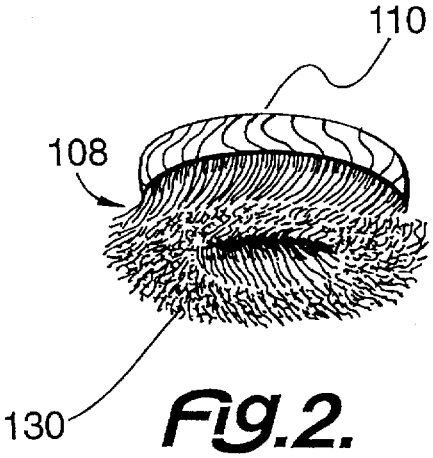
Fig. 2. PRIOR ART
FIG. 2 depicts a rotary brush 110 in a used condition 108.
Figure 4:
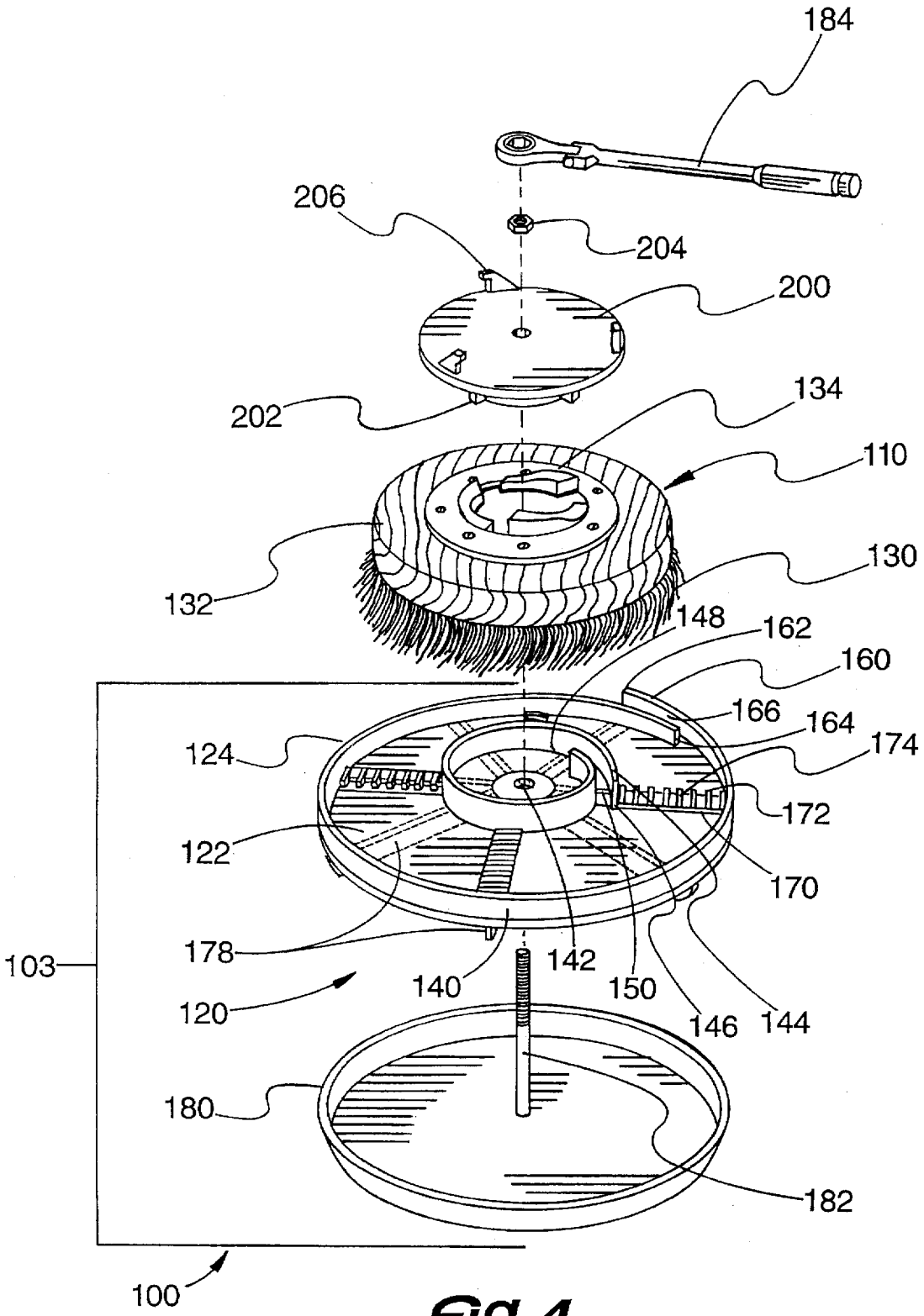
FIG. 4 depicts a perspective, exploded view of brush rejuvenating apparatus 100 receiving rotary brush 110.

Referring now to FIG. 2, brush 110 is depicted in a used condition 108. As shown in FIG. 4, the bristles 130 are mounted on one side of a brush base 132, with a clutch plate 134 mounted on the second side of brush base 132 and oppositely disposed from the bristles 130. The bristles 130 are forced in a clockwise position (used condition 108) due to the counter clockwise rotation of the carpet shampoo machine 102. With the bristles 130 forced to move to the clockwise position due to the counterclockwise of the machine 102, the efficiency of the brush 110 becomes greatly reduced.

Figure 3:
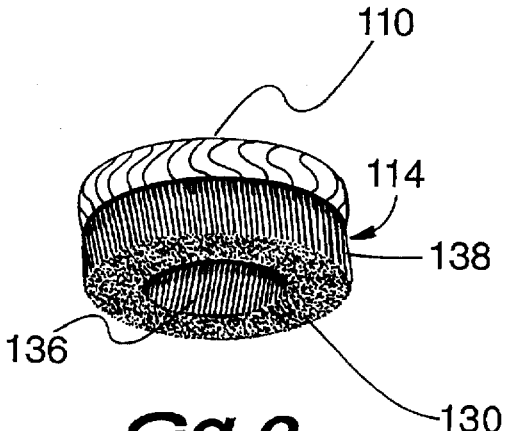
Fig. 3. PRIOR ART
FIG. 3 depicts a rotary brush 110 in a rejuvenated condition 114.

FIG. 3, depicts brush 110 after treatment of bristles 130 by the method and apparatus disclosed in the subsequent figures. Bristles 130 are straightened or moved little behind the rotation vertical point and held in that position for rejuvenated condition 114. Then the brush 110 is dried.

Figure 5:
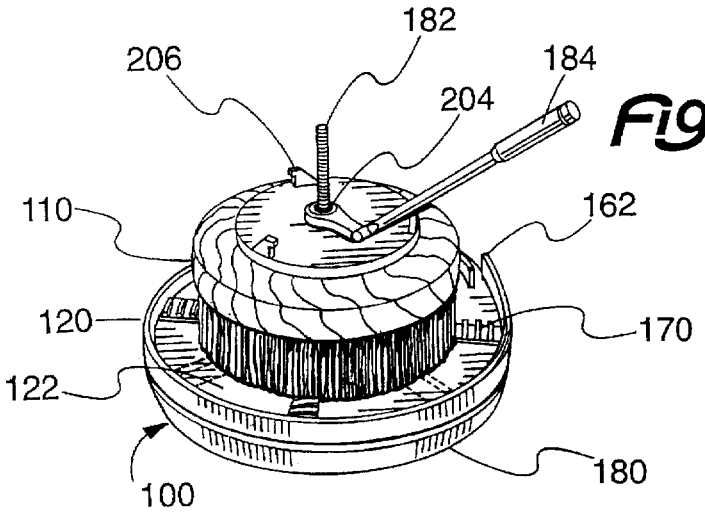
FIG. 5 depicts a top perspective, assembled view of brush rejuvenating apparatus 100 receiving rotary brush 110.

Considering FIG. 4, the brush rejuvenating apparatus 100 includes a housing 120. The housing 120 has a bristle receiving base 122 with certain bristle supporting elements thereon. Housing 120 may be one-piece (FIG. 5) or two-piece (FIG. 4). If housing 120 is two piece, comb mount 124 supporting combs 170 and spindle supported covering 180 form the separate pieces thereof. Bracket 103 indicates the possible separation into two parts of housing 120 and a spindle supported covering 180, while FIG. 5 shows shows the joinder thereof as one unit. The bristle supporting elements include an inner bristle collecting guide 140 and outer bristle collecting guide 160.

Centrally located in the housing 120 is a spindle receiving housing aperture 142. Inner bristle guide 140 is generally circular in nature. However, the inner bristle collecting guide 140 includes an inner gap 144 formed by the first or outer end 146 and the second end 148 of inner guide 140 overlapping as opposed to joining to form inner space 150. The space 150 between the ends provides a guide to position the inner bristles 136 of the brush 110.

Outer bristle guide 160 has a structure similar to inner bristle collecting guide 140. The outer bristle guide 160 has a first or outer end 162 and a second or inner end 164. Inner end 164 is adjacent to outer end 146 of inner bristle collecting guide 140. Outer end 162 of outer bristle collecting guide 160 is of course outside of inner end 164. There is also an outer space 166 therebetween. Outer bristle space 166 receives outer bristles 138 and straightens the same.

Inner space 150 and outer space 166 permit the guiding of the bristles 130 into the appropriate straightened position. Inner space 150 is radially separated from outer space 166 by up to about 25 degrees as measured between a radius drawn to outer end 162 and second end 148. More preferably, inner space 150 is radially separated from outer space 166 by about 5 to about 25 degrees. Most preferably, inner space 150 is radially separated from outer space 166 by about 5 to about 20 degrees. Both inside bristle array 136 (shown in FIG. 3) and outside bristle array 138 (also shown in FIG. 3) are thus straightened. Thus, at both points, bristles 130 can be straightened to greatly lengthen the useful life of the brush 110.

Radially spaced about the bristle receiving base 122 are a series of bristle combs 170. These bristles combs 170 are of a generally inclined plane nature. Each comb 170 includes raised portions 172 relative to a base portion 174, which provide comb-like teeth and serve to guide the bristles 130 appropriately as the bristles 130 are contacting the bristle receiving base 122 of the housing 120. While the bristle combs 170 are shown as four in number as preferred, that number is adjustable. Bristle combs 170 may number from one to six.

As the bristles 130 are maneuvered for brush rejuvenation, a spindle supported covering 180 having a spindle 182 mounted therein is placed adjacent to housing 120. Spindle 182 is then passed through the aperture 142 and through the clutch plate 134 of the brush 130. The clutch plate receiver 200 is placed on top of the brush 130 adjacent to the clutch plate 134.

More preferably, as the bristles 130 are maneuvered for brush rejuvenation, a spindle supported covering 180 having a spindle 182 mounted therein is secured to housing 120. Spindle 182 is then received through the aperture 142 in housing 120 and through the clutch plate 134 of the brush 130. The clutch plate receiver 200 is placed on top of the brush 130 adjacent to the clutch plate 134.

This clutch plate receiver 200 includes various ridges 202, preferably three in number, to lock into the clutch plate 134 and be secured to the housing 120. The spindle locking nut 204 is placed over the spindle 182 and tightened appropriately in any suitable fashion.

Figure 6:
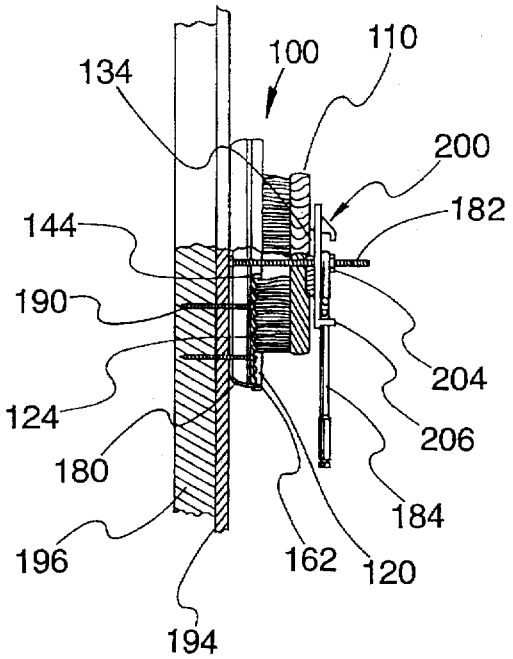
FIG. 6 depicts a side view of brush rejuvenating apparatus 100, based on FIG. 5.
Figure 7:
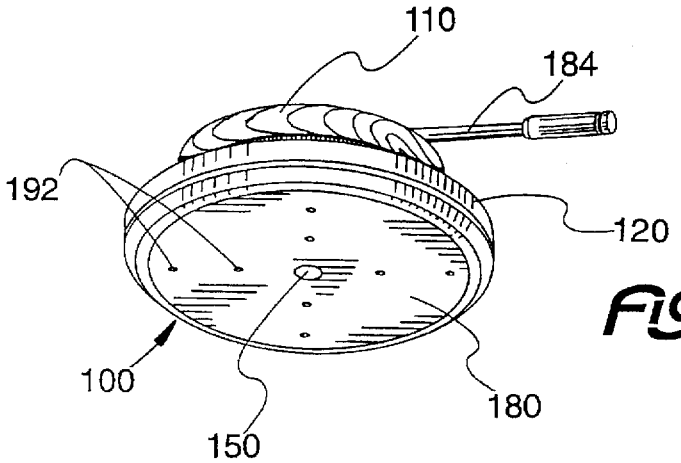
FIG. 7 depicts a bottom perspective view of brush rejuvenating apparatus 100, based on FIG. 5.

Adding FIG. 5, FIG. 6 and FIG. 7 to the consideration, preferably, a spindle ratchet wrench 184 is used. A series of wrench cradles 206, preferably three in number, are radially spaced about the clutch plate receiver 200, which serves as the clamping device. In this fashion, as the nut 204 is tightened on the clutch plate receiver 200, the brush 110 is rotated in a counter clockwise fashion and the bristles 130 are properly positioned.

More particularly, FIG. 6 depicts the brush rejuvenating apparatus 100 modified sufficiently to be mounted on a wall in substantially the same manner as depicted in the above-cited application, by the same inventor. The housing 120 is secured through wall sheet 170 into a wall joist 172. Bolts 190 support the housing 120 on the wall.

Considering FIG. 6 and FIG. 7 together, spindle supported covering 180 includes covering apertures 192 to receive bolts 190. Bolts 190 pass through apertures 192 into wall 194 and wall support 196 in order firmly support the housing. The following example is intended to illustrate, without unduly limiting, the scope of this invention.

EXAMPLE

A standard rotary scrubbing machine is used for a daily cleaning machine. A first brush is used on even days of the month. A second brush is used on the odd days of the month. The first brush is treated with the apparatus of this invention and permitted to dry between uses. The comb assembly 170 help guide the bristles 130 around inner bristle guide 140 and within outer bristle guide 160 to be held there until dried.

The second brush remains untreated with the apparatus of this invention but is otherwise permitted to dry and be preserved. Over the life of the brush, the second brush, which is untreated, with the straightening process of brush rejuvenating apparatus of this invention lasts two (2) months. The second brush, which is treated, lasts nine (9) months.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. An apparatus for rejuvenating a rotary brush in a used condition in order to convert the rotary brush into a rejuvenated condition, the rotary brush including a rotary base, a mounting assembly on a first side of the rotary base and a plurality of bristles on a second side of the rotary base, the apparatus-comprising:

a) a reversing means, a holding means, and a bristle-contact means cooperating to form the apparatus;

b) the holding means supporting the bristle-contact means;

c) the reversing means being capable of holding the plurality of bristles against the bristle-contact means and reversing the direction of rotation for the brush;

d) the plurality of bristles having an inner circle of bristles and an outer circle of bristles; and e) the bristle-contact means including a first holding means to support the inner circle of bristles in a first rejuvenating position and a second holding means to support the outer circle of bristles in a second rejuvenating position, thereby providing that the rotary brush be changed from the used condition into the rejuvenated condition.

2. The apparatus for rejuvenating a rotary brush of claim 1 further comprising:

a) the first holding means to support the inner circle of bristles in the first rejuvenating position including an inner bristle collecting guide; and b) the second holding means to support the outer circle of bristles in the second rejuvenating position being an outer bristle collecting guide.

3. The apparatus for rejuvenating a rotary brush of claim 2 further comprising:

a) the bristle-contact means further including at least one bristle comb to drive the plurality of bristles into a rejuvenating position;

b) the at least one bristle comb serving to restrict the plurality of bristles from flexing sideways; and c) the at least one bristle comb providing a hurdle for the plurality of bristles.

4. The apparatus for rejuvenating a rotary brush of claim 3 further comprising the at least one bristle comb restricting a sideways flexing sideways of the plurality of bristles.

5. The apparatus for rejuvenating a rotary brush of claim 4 further comprising:

a) the inner bristle collecting guide supporting the plurality of bristles outside thereof;

b) the outer bristle collecting guide supporting the plurality of bristles inside thereof; and c) the plurality of bristles being thus driven into a straight array for rejuvenating the rotary brush.

6. The apparatus for rejuvenating a rotary brush of claim 5 further comprising:

a) the holding means including a clamping device;

b) the clamping device being positionable adjacent to the mounting assembly of the rotary brush;

c) the clamping device being rotatable in a reverse direction to a direction of the plurality of bristles until the bristles are least substantially straightened; and d) a locking means for securing the clamping device in place.

7. The apparatus for rejuvenating a rotary brush of claim 6 further comprising:

a) a housing including a spindle to receive the rotary brush and the clamping device; and b) the locking means including a spindle receiving nut securing the clamping device.

8. The apparatus for rejuvenating a rotary brush of claim 6 further comprising:

a) the inner bristle collecting guide having a first inner end and a second inner end;

b) the inner bristle collecting guide being substantially circular;

c) the first inner end overlapping the second inner end to create an inner gap therebetween;

d) the outer bristle collecting guide having a first outer end and a second outer end;

e) the outer bristle collecting guide being substantially circular;

f) the first outer end overlapping the second outer end to create an outer gap therebetween; and g) inner bristle collecting guide having a reversed direction relative to the outer bristle collecting guide.

9. The apparatus for rejuvenating a rotary brush of claim 8 further comprising:

a) the at least one bristle comb being positioned between the inner bristle collecting guide and the outer bristle collecting guide; and b) the at least one bristle comb being one to six in number and being spaced radially on the housing.

10. The apparatus for rejuvenating a rotary brush of claim 9 further comprising:

a) the housing including a centrally located spindle receiving housing aperture with the spindle mounted therein;

b) the spindle being adapted to receive the brush with the plurality of bristles adjacent to the housing;

c) the spindle receiving the clamping device; and d) the clamping device being adapted to receive the mounting assembly on the first side of the rotary base.

11. The apparatus for rejuvenating a rotary brush of claim 10 further comprising:

a) the clamping device being received over the spindle;

b) a first side of the clamping device cooperating with the locking means for receiving the mounting device of the rotary brush;

c) the clamping device including up to four cradles on a second side, the second side being oppositely disposed to the first side; and d) the up to four cradles serving to support a tightening of a nut on the spindle.

12. The apparatus for rejuvenating a rotary brush of claim 11 further comprising:

a) the nut cooperating with a spindle ratchet wrench for tightening and releasing the clamping device on the spindle; and b) the up to four cradles cooperating with the spindle ratchet wrench for tightening and releasing the clamping device on the spindle; and c) the up to four cradles being adapted to receive and hold the spindle ratchet wrench in a fixed position.

13. An apparatus for rejuvenating a rotary brush in a used condition in order to convert the rotary brush into a rejuvenated condition, the rotary brush including a rotary base, a mounting assembly on a first side of the rotary base and a plurality of bristles on a second side of the rotary base, the apparatus comprising:

a) a reversing means, a holding means, and a bristle-contact means cooperating to form the apparatus;

b) the holding means supporting the bristle-contact means;

c) the reversing means being capable of holding the plurality of bristles against the bristle-contact means and reversing the direction of rotation for the brush;

d) the plurality of bristles having an inner circle of bristles and an outer circle of bristles;

e) the bristle-contact means including a first holding means to support the inner circle of bristles in a first rejuvenating position and a second holding means to support the outer circle of bristles in a second rejuvenating position, thereby providing that the rotary brush be changed from the used condition into the rejuvenated condition;

f) the first holding means to support the inner circle of bristles in the first rejuvenating position including an inner bristle collecting guide;

g) the second holding means to support the outer circle of bristles in the second rejuvenating position being an outer bristle collecting guide;

h) the bristle-contact means further including at least one bristle comb to drive the plurality of bristles into a rejuvenating position;

i) the at least one bristle comb serving to restrict the plurality of bristles from flexing sideways;

j) the at least one bristle comb providing a hurdle for the plurality of bristles;

k) the holding means including a housing with a spindle mounted in the housing; and l) the spindle being adapted to receive a clamping device and the rotary brush.

14. The apparatus for rejuvenating a rotary brush of claim 13 further comprising:

(a) the at least one bristle comb restricting a sideways flexing sideways of the plurality of bristles;

(b) the inner bristle collecting guide supporting the plurality of bristles outside thereof;

(c) the outer bristle collecting guide supporting the plurality of bristles inside thereof; and (d) the plurality of bristles being thus driven into a straight array for rejuvenating the rotary brush.

15. The apparatus for rejuvenating a rotary brush of claim 14 further comprising:

a) the holding means including the clamping device;

b) the clamping device being positionable adjacent to the mounting assembly of the rotary brush;

c) the clamping device being rotatable in a reverse direction to a direction of the plurality of bristles until the bristles are least substantially. straightened;

d) a locking means for securing the clamping device in place;

e) the inner bristle collecting guide having a first inner end and a second inner end;

f) the inner bristle collecting guide being substantially circular;

g) the first inner end overlapping the second inner end to create an inner gap therebetween;

h) the outer bristle collecting guide having a first outer end and a second outer end;

i) the outer bristle collecting guide being substantially circular;

j) the first outer end overlapping the second outer end to create an outer gap therebetween; and k) inner bristle collecting guide having a reversed direction relative to the outer bristle collecting guide.

16. The apparatus for rejuvenating a rotary brush of claim 15 further comprising:

a) the at least one bristle comb being positioned between the inner bristle collecting guide and the outer bristle collecting guide;

b) the at least one bristle comb being one to six in number and being spaced radially on the housing;

c) the housing including a centrally located spindle receiving housing aperture with the spindle mounted therein;

d) the spindle being adapted to receive the brush with the plurality of bristles adjacent to the housing;

e) the spindle receiving the clamping device;

f) the clamping device being adapted to receive the mounting assembly on the first side of the rotary base;

g) the clamping device being received over the spindle;

h) a first side of the clamping device cooperating with the locking means for receiving the mounting device of the rotary brush;

i) the clamping device including up to four cradles on a second side, the second side being oppositely disposed to the first side; and j) the up to four cradles serving to support a tightening of a nut on the spindle.

17. The apparatus for rejuvenating a rotary brush of claim 16 further comprising:

a) the nut cooperating with a spindle ratchet wrench for tightening and releasing the clamping device on the spindle; and b) the up to four cradles cooperating with the spindle ratchet wrench for tightening and releasing the clamping device on the spindle; and c) the up to four cradles being adapted to receive and hold the spindle ratchet wrench in a fixed position.

18. A method for rejuvenating a used rotary brush to restore the effectiveness thereof, the rotary brush including a rotary base, a mounting assembly on a first side of the rotary base and a plurality of bristles on a second side of the rotary base, the used rotary brush having the plurality of bristles in a position to be ineffective as a scrubbing tool, the method comprising:

a) holding the plurality of bristles of the used rotary brush in at least a vertical position, the plurality of bristles having an inner circle and an outer circle;

b) supporting both the inner circle and the outer circle to cooperate with the at least a vertical position to provide a desired drying position;

c) allowing the used rotary brush to dry with the plurality of bristles supported in the desired drying position to provide a rejuvenated rotary brush; and d) recovering the rejuvenated rotary brush.

19. The method of claim 18 further comprising:

a) the at least vertical position proceeding beyond the vertical to achieve a better brush utility; and b) the at least vertical position being achieved by a counter use rotation.

* * * * *